US011933127B2

(12) United States Patent
Morrison et al.

(10) Patent No.: US 11,933,127 B2
(45) Date of Patent: Mar. 19, 2024

(54) SYSTEM AND METHOD FOR CONTROLLED DOWNHOLE CHEMICAL RELEASE

(71) Applicant: Schlumberger Technology Corporation, Sugar Land, TX (US)

(72) Inventors: Richard Morrison, Sugar Land, TX (US); Sascha Trummer, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 62 days.

(21) Appl. No.: 17/767,942

(22) PCT Filed: Oct. 9, 2020

(86) PCT No.: PCT/US2020/070637
§ 371 (c)(1),
(2) Date: Apr. 11, 2022

(87) PCT Pub. No.: WO2021/072433
PCT Pub. Date: Apr. 15, 2021

(65) Prior Publication Data

US 2023/0332476 A1 Oct. 19, 2023

Related U.S. Application Data

(60) Provisional application No. 62/914,116, filed on Oct. 11, 2019.

(51) Int. Cl.
*E21B 27/02* (2006.01)

(52) U.S. Cl.
CPC ..... *E21B 27/02* (2013.01)

(58) Field of Classification Search
CPC ..... E21B 27/02
See application file for complete search history.

(56) References Cited

U.S. PATENT DOCUMENTS 5,778,978 A * 7/1998 Crow ..... E21B 33/072 166/254.2
6,543,544 B2 4/2003 Schultz et al.
(Continued)

OTHER PUBLICATIONS

International Preliminary Report on Patentability issued in International Patent application PCT/2020/07063, dated Apr. 21, 2022, 7 pages.

(Continued)

*Primary Examiner* — Taras P Bemko
(74) *Attorney, Agent, or Firm* — Jeffrey D. Frantz

(57) ABSTRACT

A technique facilitates precision fluid conveyance and placement to one or more desired locations in a borehole, e.g. a wellbore. According to an embodiment, a material container, e.g. a fluid container, and/or a fluid flow path system may be deployed downhole via coiled tubing. A release system is selectively actuatable to release a specific amount or amounts of material, e.g. treatment fluid, at the one or more desired locations along the borehole. Depending on the application, various discharge mechanisms and/or supply mechanisms may be used in cooperation with the material container and/or fluid flow path system to provide the precision fluid conveyance and placement.

20 Claims, 2 Drawing Sheets

(56) References Cited

U.S. PATENT DOCUMENTS

| | | | | |
|---|---|---|---|---|
| 7,967,067 | B2 | 6/2011 | Irani et al. | |
| 9,890,611 | B2 | 2/2018 | Lee et al. | |
| 9,938,823 | B2 | 4/2018 | Deville et al. | |
| 10,006,282 | B2 | 6/2018 | Livescu et al. | |
| 10,309,174 | B2 | 6/2019 | Burgos et al. | |
| 10,385,680 | B2 | 8/2019 | Livescu et al. | |
| 10,697,252 | B2 | 6/2020 | Burgos et al. | |
| 10,876,377 | B2 | 12/2020 | Quero et al. | |
| 10,947,794 | B2 | 3/2021 | Noui-Mehidi | |
| 11,053,773 | B2 * | 7/2021 | Beach | E21B 27/02 |
| 2003/0131991 | A1 | 7/2003 | Hartog et al. | |
| 2008/0093077 | A1 | 4/2008 | Daccord et al. | |
| 2009/0266546 | A1 * | 10/2009 | Hill | E21B 27/02 166/305.1 |
| 2010/0155054 | A1 | 6/2010 | Innes et al. | |
| 2011/0100634 | A1 * | 5/2011 | Williamson | C09K 8/03 166/310 |
| 2013/0277047 | A1 | 10/2013 | Kuhn de Chizelle et al. | |
| 2015/0376994 | A1 | 12/2015 | Mebratu | |
| 2017/0260834 | A1 | 9/2017 | Chacon et al. | |
| 2018/0038223 | A1 | 2/2018 | Nyhavn et al. | |
| 2019/0128080 | A1 | 5/2019 | Ross et al. | |
| 2019/0203538 | A1 | 7/2019 | Wisinger, Jr. et al. | |
| 2020/0347686 | A1 * | 11/2020 | Carisella | E21B 21/003 |
| 2021/0040821 | A1 * | 2/2021 | Hoffman | E21B 33/12 |
| 2021/0071481 | A1 * | 3/2021 | Al-Abdulrahman | E21B 33/035 |
| 2021/0180422 | A1 * | 6/2021 | Alouhali | E21B 17/00 |
| 2021/0332657 | A1 * | 10/2021 | Chamarthy | E21B 27/02 |
| 2021/0404789 | A1 * | 12/2021 | Singer | G01N 33/24 |

OTHER PUBLICATIONS

International Search Report and Written Opinion issued in International Patent applicationPCT/US2020/070637 dated Jan. 20, 2021, 10 pages.

Extended Search Report issued in European Patent Application No. 20875371.5 dated Aug. 8, 2023, 7 pages.

First Examination Report SA Application No. 522432227 dated Nov. 21, 2023; 16 pages (with English Translation).

* cited by examiner

SYSTEM AND METHOD FOR CONTROLLED DOWNHOLE CHEMICAL RELEASE

CROSS-REFERENCE TO RELATED APPLICATION

The present document is a National Stage Entry of International Application No. PCT/US2020/070637, filed Oct. 9, 2020, which is based on and claims priority to U.S. Provisional Application Ser. No. 62/914,116, filed Oct. 11, 2019, which is incorporated herein by reference in its entirety.

BACKGROUND

In many well applications, coiled tubing equipment is used in well servicing and intervention operations. Depending on the operation, a bottom hole assembly (BHA) and/or other tools may be attached to an end of the coiled tubing and deployed to an area or areas of interest in the well. Coiled tubing equipment may comprise a continuous metal or composite tube deployable in a wellbore via a reel, an injector, and associated equipment located at the surface. The overall coiled tubing system also may comprise other equipment for pumping fluid through the coiled tubing, for controlling various equipment, and for providing various manifold and pressure control. Fluid may be pumped from the surface through the entire length of coiled tubing for treatment of the wellbore and/or to operate hydraulically powered downhole tools. However, current systems are limited with respect to precision fluid conveyance and placement at desired locations in a borehole.

For example, use of traditional coiled tubing pumping techniques involves filling the entire volume of coiled tubing to displace fluid into the reservoir when overbalanced conditions exist. Conversely, when underbalanced conditions exist, the treatment may suffer due to uncontrolled fluid loss from the coiled tubing to the reservoir via a u-tubing effect. Thus, placement of a controlled and relatively small volume of fluid can be problematic. For wireline and slick line applications, small quantities of fluid can sometimes be placed using a dump bailer. However, dump bailers have very limited volume; are not easily conveyed into deviated, e.g. horizontal, well sections; and are not amenable to providing mixing with secondary fluid treatments due to a lack of pumping capacity. Furthermore, reliance on gravity release limits the effectiveness of fluid placement in horizontal sections.

SUMMARY

In general, a system and methodology provide for precision fluid conveyance and placement to one or more desired locations in a borehole, e.g. a wellbore. According to an embodiment, a material delivery system may comprise a material container and/or a fluid flow path system. The material delivery system may be deployed downhole via coiled tubing. A release system is selectively actuatable to release a specific amount or amounts of material, e.g. treatment fluid or other material, at the one or more desired locations along the borehole. Depending on the application, various discharge mechanisms and/or supply mechanisms may be used in cooperation with the material container and/or fluid flow path system to provide the precision fluid conveyance and placement. The precision fluid conveyance and placement may be initiated by, for example, sending a signal via a telemetric line from the surface to thus enable on-command precision fluid placement using coiled tubing.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for precision fluid conveyance and placement to one or more desired locations in a borehole, e.g. a wellbore. The technique enables on-command precision fluid placement while using a coiled tubing system. According to an embodiment, the technique employs a material delivery system which may comprise a material container and/or a fluid flow path system which are deployed downhole via coiled tubing. A release system is selectively actuatable to release a specific amount or amounts of fluid, e.g. treatment fluid, at the one or more desired locations along the borehole. Depending on the application, various discharge mechanisms and/or supply mechanisms may be used in cooperation with the material container and/or fluid flow path system to provide the precision fluid conveyance and placement. Actuation of the release system and/or discharge mechanism may be initiated by, for example, sending a signal via a telemetric line from the surface to thus enable precision fluid placement using coiled tubing.

In some embodiments, the equipment for providing the precision fluid placement may be located in a bottom hole assembly (BHA) deployed downhole via the coiled tubing. In such a system, a signal may be sent via a wired or wireless telemetric line from the surface to the BHA. The signal is used to trigger release of a controlled amount of material, e.g. cement slurry or other treatment fluid. The controlled release of fluid may be done "on-command" when real-time telemetry is present or on a delay. Furthermore, the signal may be carried from the surface via a physical telemetric line, e.g. a telemetric line routed along the interior of the coiled tubing or within a wall of the coiled tubing.

In some embodiments, a complementary fluid or fluid mixture may be pumped down through the coiled tubing for downhole combination with a secondary material. For example, the BHA may be constructed to enable initiation of a controlled release of the secondary material on-command to act with or mix with the pumped fluid to form a desired treatment fluid.

Figure 1:
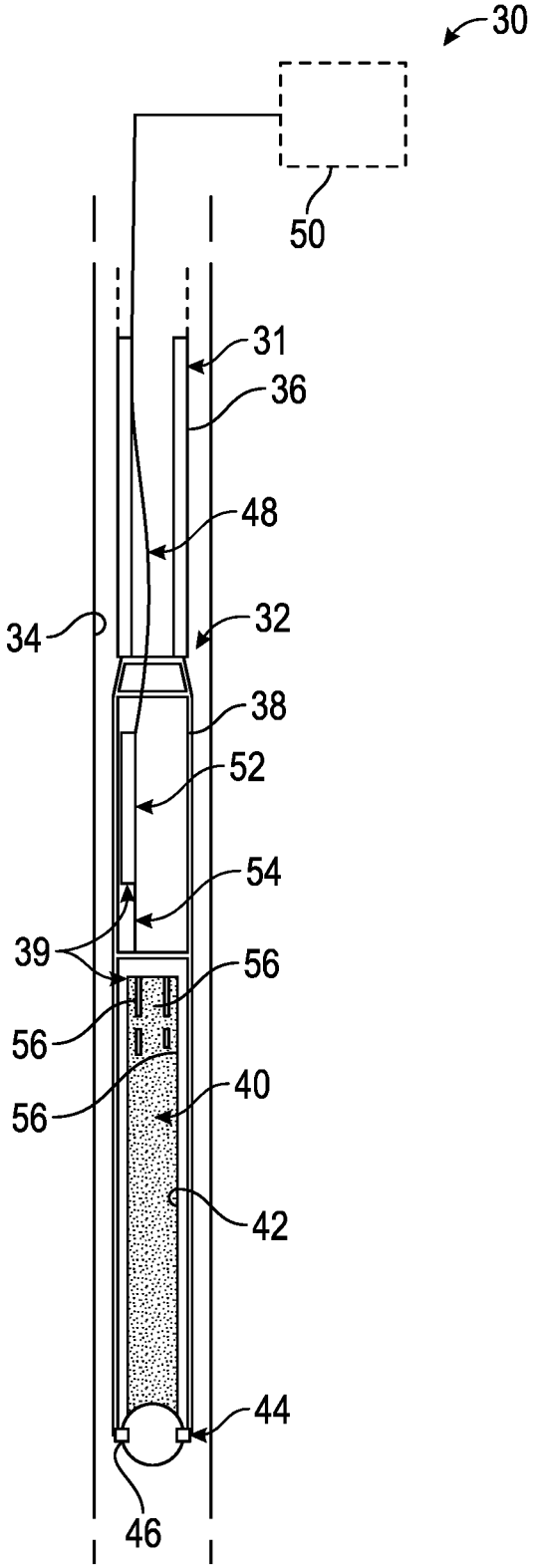
FIG. 1 is a schematic illustration of an example of a downhole fluid conveyance and placement system, according to an embodiment of the disclosure.

Referring generally to FIG. 1, an example of a well system 30 able to provide precision fluid conveyance and placement along a borehole is illustrated. In this example, well system 30 comprises a well string 31. The well string 31 includes well equipment 32 deployed downhole into a borehole 34, e.g. a wellbore, via coiled tubing 36. The well equipment 32 may comprise various types and combinations of equipment and may be in the form of a bottom hole assembly (BHA) 38. Additionally, the well equipment 32 comprises a material delivery system 39 for precisely placing relatively small quantities of a material 40, e.g. cement slurry, treatment chemicals, and/or other materials, at a desired location or locations downhole.

According to the embodiment illustrated, the material delivery system 39 may employ a prefilled volume of material 40 placed in a container, e.g. a fluid chamber, 42 which may be part of BHA 38 (or other suitable downhole equipment). The container 42 may be constructed as a fit-for-purpose material chamber for containing desired material 40 which may be in the form of fluids and/or other materials. Additionally, container 42 may be formed of various metal materials or non-metal materials, e.g. polytetrafluoroethylene (PTFE). The material 40 is contained in container 42 via a release system 44 which may comprise an actuatable valve 46 or other suitable release mechanism. The actuatable valve 46 may be located at a downhole end of container 42 or at another suitable position. In the illustrated example, the release system 44 is actuated in response to a signal sent from, for example, the surface.

The signal may be sent over a suitable wireless or wired telemetric line 48 coupled with a control system 50, e.g. a surface control system. By way of example, the telemetric line 48 may be a physical line routed from the surface down through an interior of the coiled tubing 36 to a downhole receiver 52. However, the telemetric line 48 may be routed along other paths, e.g. within a wall of the coiled tubing 36. In some embodiments, the telemetric line 48 may be wireless in whole or in part.

The downhole receiver 52 may be located within BHA 38 or within other suitable equipment and may be coupled with release system 44 via a release command signal control line 54. The control line 54 may be an electric control line, hydraulic control line, or other suitable control line selected to operate the corresponding release system 44.

In operation, the prefilled container 42 is conveyed downhole to a desired location at a target depth to enable an on-command release of the material 40. For example, a signal may be sent from surface control system 50 via telemetric line 48. The signal is received by the downhole receiver 52 which commands the release system 44, e.g. an actuator of the release system 44, to actuate and thus release material 40 from the prefilled container 42 and into the borehole 34. A metered quantity of the material 40 or the entire volume of material 40 may be selectively released.

In some embodiments, the container 42 may comprise a plurality of individual fluid chambers 56 or other material chambers. The chambers 56 work in cooperation with corresponding release valves 46 or other release mechanisms to enable selective, e.g. sequential, release of similar or dissimilar materials 40 from the plurality of containers 56.

Figure 2:
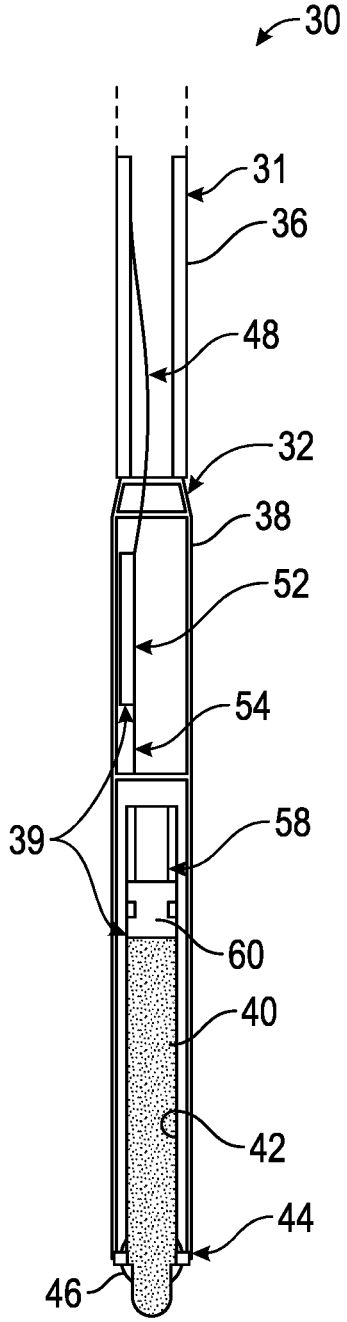
FIG. 2 is a schematic illustration of another example of a downhole fluid conveyance and placement system, according to an embodiment of the disclosure.

Referring generally to FIG. 2, another embodiment of material delivery system 39 is illustrated as having a discharge mechanism 58 which works in cooperation with release system 44. By way of example, the discharge mechanism 58 may be a forcing mechanism which may be automated or actuated via suitable signals sent via telemetric line 48. In some embodiments, the discharge mechanism 58 may comprise a piston 60 selectively shiftable along the interior of container 42 to forcibly discharge a predetermined quantity of material 40 into the surrounding borehole 34 at a desired location. For example, release system 44 may comprise a burst disc which bursts once sufficient force is applied via piston 60 so that piston 60 may then be shifted to discharge the desired material 40 from container 42.

Figure 3:
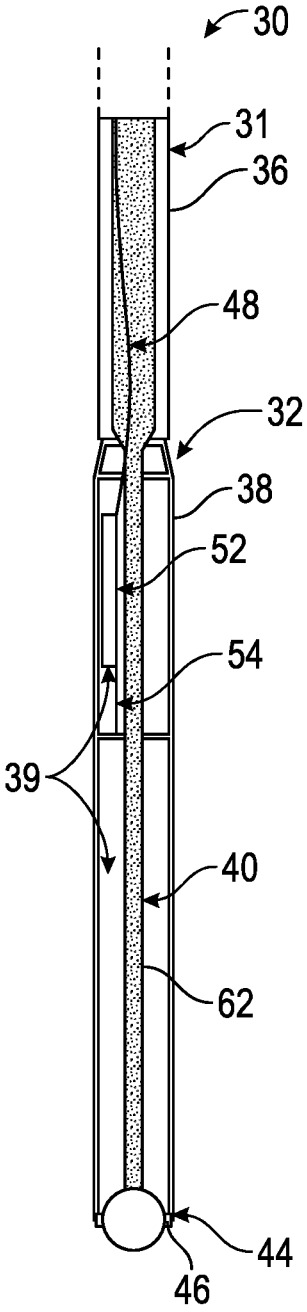
FIG. 3 is a schematic illustration of another example of a downhole fluid conveyance and placement system, according to an embodiment of the disclosure.

In another embodiment of material delivery system 39, material 40 may comprise a fluid contained along a flow path 62 located within BHA 38 and closed off by release system 44, as illustrated in FIG. 3. The flow path 62 may extend up to and, in some applications, may include at least a portion of the coiled tubing 36 to provide the desired quantity of fluid/material 40 for placement at the desired location along borehole 34.

Figure 4:
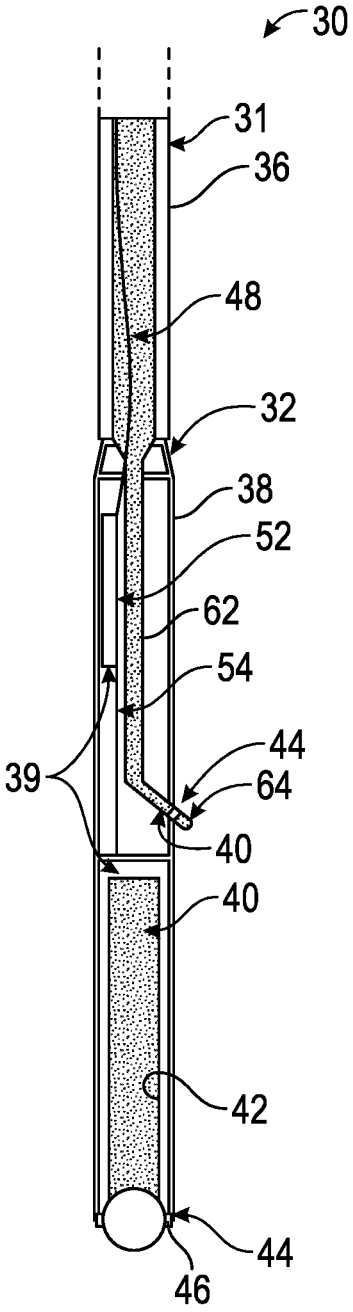
FIG. 4 is a schematic illustration of another example of a downhole fluid conveyance and placement system, according to an embodiment of the disclosure.

Embodiments of material delivery system 39 may comprise various combinations of containers 42, flow paths 62, telemetric lines 48, and/or other system components. As illustrated in FIG. 4, for example, the BHA 38 comprises container 42 (which may have one or more chambers 56) for containing desired materials 40. Additionally, the BHA 38 comprises separate flow path 62 along which material 40 may be contained or along which a complementary fluid may be pumped. The flow path 62 may have a corresponding fluid exit 64 combined with another release system 44 through which fluids may be discharged via, for example, the pressure of fluid pumped down through coiled tubing 36. The materials 40 within container 42 and/or disposed along flow path 62 may be independently delivered and placed at a desired location or locations in borehole 34.

The material 40 may be discharged at the desired location via gravity or via an actuator, e.g. piston 60. In some embodiments, a complementary fluid or fluid mixture may be pumped down through coiled tubing 36 and flow path 62 for discharge through fluid exit 64. This complementary fluid may be mixed with a secondary chemical/material 40 selectively released from container 42 to set off a desired chemical reaction. Depending on the application, the chemical/material 40 may be released into the complementary fluid/mixture or the chemical/material 40 may be released first and the complementary fluid/mixture may then be pumped down on top of the chemical/material 40.

Embodiments described herein enable on-command downhole release of desired materials. For example, an operator can pre-fill a container 42 and/or flow path 62 (which may include at least a portion of coiled tubing 36) with a predetermined volume of at least one material 40, e.g. a fluid treatment material. The material (or materials) 40 is then conveyed downhole via coiled tubing 36 to a target location within the borehole/wellbore 34. Once at the desired location and at target depth, the material 40 is selectively released.

Using on-command downhole release of a desired chemical/material 40 enables operators to pump downhole a sufficient volume of a first chemical and then use a different material/chemical 40 of smaller volume for activation. The smaller volume of chemical 40 may be contained within container 42 (and/or sometimes flow path 62) and then selectively released into the first chemical, according to methods described herein. Controlled release of the smaller volume of chemical 40 creates a desired chemical reaction at target depth. This can produce an improved chemical reaction at the desired location as opposed to co-mingling the chemicals in pumping equipment and/or within the coiled tubing.

Examples of reactions include exothermic reactions so that changes may be sensed using, for example, a distributed temperature sensing system. Additional examples of reactions include solidifying reactions to intentionally create obstructions. However, a variety of other reactions may be initiated downhole via the controlled placement and release of a desired chemical from, for example, container 42.

Furthermore, use of discharge mechanism 58, e.g. piston 60, and/or pumped pressure on top of a prefilled volume of fluid along the flow path 62/coiled tubing 36 enables forced release of desired materials 40. This approach can effectively create a different type of dump bailer for small volumes of material 40, e.g. cement slurry, for placement in horizontal or otherwise deviated sections of the borehole 34 where the force of gravity acts transversely with respect to BHA 38.

It should be noted the configuration of well system 30 may change according to the parameters of a given operation and environment. Well system 30 may comprise various types of well strings 31 which have suitable equipment 32 constructed as bottom hole assembly 38 and/or as other types of equipment located along the coiled tubing 36. Similarly, various containers 42, flow paths 62, release systems 44, discharge mechanisms 58, downhole receivers 52, telemetry systems, and/or other systems and components may be selected according to objectives and environmental considerations of a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string having well equipment coupled to coiled tubing for deployment downhole into a borehole, the well equipment including a material delivery system configured to release material into the borehole, wherein the material delivery system comprises a flow path system configured to receive a fluid, different from the material, from the coiled tubing and to release the fluid into the borehole before, after, or while the material delivery system releases the material into the borehole such that the fluid mixes with the material in the borehole, wherein mixing of the fluid and the material within the borehole causes a chemical reaction;

a control system positioned at a surface location; and a telemetric line coupling the control system with the material delivery system, the control system being configured to provide signals to the material delivery system to initiate the release of a metered amount of the material at a desired location along the borehole.

2. The system as recited in claim 1, wherein the well equipment comprises a bottom hole assembly (BHA).

3. The system as recited in claim 1, wherein the material delivery system comprises a material container configured to hold a volume of the material and a release system actuatable to selectively release the metered amount of the material.

4. The system as recited in claim 3, wherein the release system comprises an actuatable valve disposed at a distal end of a downhole end of the material container.

5. The system as recited in claim 3, wherein the material container comprises a plurality of separate fluid chambers.

6. The system as recited in claim 3, wherein the material delivery system further comprises a discharge mechanism which cooperates with the material container to force discharge of the metered amount of the material.

7. The system as recited in claim 6, wherein the discharge mechanism comprises an actuatable piston.

8. The system as recited in claim 3, wherein the material delivery system further comprises a downhole receiver, the telemetric line being coupled between the control system and the downhole receiver, the downhole receiver being connected to the release system via a control line.

9. The system as recited in claim 3, wherein the release system comprises a burst disc configured to burst in response to an applied force and release the metered amount of the material.

10. The system as recited in claim 3, wherein the metered amount of the material comprises an entirety of the volume of the material of the material container.

11. The system as recited in claim 1, wherein the material delivery system comprises a fluid flow path system configured to receive the material from the coiled tubing and release the metered amount of the material into the borehole.

12. The system as recited in claim 1, wherein the telemetric line comprises a wired telemetric line disposed along an interior of the coiled tubing or within a sidewall of the coiled tubing.

13. A system for use in a well, comprising:

a coiled tubing;

a material delivery system coupled to the coiled tubing for deployment downhole into a borehole, the material delivery system comprising:

a container configured to hold a volume of a first material;

a release mechanism configured to selectively release at least a portion of the first material from the container and into the borehole; and a flow path fluidly coupled to the coiled tubing and configured to receive a second material via the coiled tubing and to release the second material into the borehole; and a control system configured to independently regulate the release of the first material into the borehole and the release of the second material into the borehole.

14. The system as recited in claim 13, wherein the container comprises a plurality of fluid chambers configured to hold a plurality of respective fluids, wherein the first material comprises a respective fluid of the plurality of respective fluids.

15. The system as recited in claim 13, wherein the release mechanism comprises an actuatable valve.

16. The system as recited in claim 13, wherein the material delivery system further comprises a discharge mechanism for forcing discharge of the first material from the container.

17. The system as recited in claim 13, wherein the flow path comprises a second release mechanism configured to selectively release at least a portion of the second material into the borehole.

18. A method, comprising:

conveying a material delivery system into a borehole via coiled tubing, the material delivery system comprising:

a container configured to hold a volume of a first material;

a first release mechanism configured to release at least a portion of the volume of the first material from the container and into the borehole; and a second release mechanism fluidly coupled to the coiled tubing and configured to receive a second material from the coiled tubing and to release the second material into the borehole; and independently actuating the first release mechanism, the second release mechanism, or both, to respectively release the first material, the second material, or both into the borehole.

19. The method as recited in claim 18, wherein actuating the first release mechanism comprises opening a valve.

20. The method as recited in claim 18, wherein independently actuating the first release mechanism, the second release mechanism, or both comprises independently actuating the first release mechanism, and wherein the method further comprises, during actuating of the first release mechanism, actuating a discharge mechanism to forcibly discharge the first material from the container and into the borehole.

* * * * *